US006682395B2

(12) United States Patent
Falla et al.

(10) Patent No.: US 6,682,395 B2
(45) Date of Patent: Jan. 27, 2004

(54) PROTECTED UNDERWIRE

(75) Inventors: Gloria Falla, Demarest, NJ (US); Deborah Batcha, New York, NY (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/313,992

(22) Filed: Dec. 6, 2002

(65) Prior Publication Data

US 2003/0134569 A1 Jul. 17, 2003

Related U.S. Application Data

(60) Provisional application No. 60/338,842, filed on Dec. 6, 2001, and provisional application No. 60/410,077, filed on Sep. 12, 2002.

(51) Int. Cl.[7] ..... A41C 3/00

(52) U.S. Cl. ..... 450/41; 2/255

(58) Field of Search ..... 450/41, 42, 45–51, 450/53; 2/255–260, 260.1, 261, 264

(56) References Cited

U.S. PATENT DOCUMENTS

| | | | | |
|---|---|---|---|---|
| 2,900,982 A | | 8/1959 | Lopez-Henriquez | |
| 3,114,374 A | | 12/1963 | Chalfin et al. | |
| 3,562,802 A | | 2/1971 | Avis | |
| 3,605,753 A | | 9/1971 | Schwartz | |
| 3,726,286 A | | 4/1973 | Wolfson | |
| 3,964,491 A | | 6/1976 | Martini | |
| 4,203,449 A | * | 5/1980 | Winzelberg | 450/41 |
| 5,215,494 A | | 6/1993 | Flanagan | |
| 5,669,247 A | | 9/1997 | McCartney et al. | |
| 5,730,640 A | | 3/1998 | Acx et al. | |
| 6,053,800 A | | 4/2000 | Lattanzi | |
| 6,190,232 B1 | | 2/2001 | Boser | |
| 6,435,939 B1 | | 8/2002 | Lin | |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

In a first embodiment, a first fabric layer has gelatinous strips, thereby separating the first fabric layer into sections. A second fabric layer is positioned upon the first fabric layer, and an underwire is positioned on the second fabric layer opposite the first fabric layer. The first fabric layer is then folded onto itself to enclose the second fabric layer and the underwire. In a second embodiment, a third, or intermediate, fabric layer is positioned between the first and second fabric layers. In a third embodiment, an underwire is surrounded by a first, non-woven fabric layer. A second, rigid-type fabric having a bladder with a gelatinous material is positioned on the first fabric. The first fabric is wrapped around the underwire, and the bladder is positioned against the body of the wearer.

34 Claims, 7 Drawing Sheets

PROTECTED UNDERWIRE

This application claims benefit of Provisional Nos. 60/338,842 filed Dec. 6, 2001 and 60/410,077 filed Sep. 12, 2002.

BACKGROUND OF THE INVENTION

1. Field of the Invention

The present invention relates to brassieres. More particularly, the present invention relates to a protected brassiere underwire and method of making the same.

2. Description of the Related Art

The use of underwire elements, especially U-shaped underwires, for shaping and supporting the lower periphery of brassiere or bra cups has long been known in the art. The term "underwire" has been in common use to refer to such elements. An underwire includes metal wires, coated metal wires, as well as wire elements made of many different materials, such as plastic or other polymeric materials. These underwires must be rigid enough, particularly in the plane of the brassiere, to provide adequate support for the bust and yet flexible enough to conform easily to the wearer's body for comfort and appearance. Such underwires are provided in a variety of shapes and configurations and must satisfy a number of requirements. For example, the underwire must not poke through the fabric to cause damage to the clothing of the wearer, and possibly injury to the wearer. It also must be readily insertable. Commonly, such underwires have been inserted into fabric sleeves disposed about the lower periphery of the bra cups.

Modern underwires are generally formed of relatively thin lengths of metal or polymeric material having a rectangular or rounded cross-section. A fairly stiff length of such material is shaped into a generalized U-shape and positioned in a sleeve disposed about the lower periphery of each bra cup. These stiff metal underwires are sometimes coated with various polymeric materials and often have plastic or enamel tips disposed at each end of the underwire.

While underwires have achieved widespread usage, certain disadvantages result from their use. These disadvantages relate to the relative stiffness, and therefore discomfort of these conventional underwires, and to the uniformity of that stiffness and, thus, the lack of adaptability to the needs of various users.

In light of the foregoing, there is an ongoing need for underwires or underwire structures, that are comfortable to wear, resilient, and adequately support the breasts of the wearer.

SUMMARY OF THE INVENTION

It is an object of the present invention to provide a cushion feel underwire or underwire structure.

It is an another object of the present invention to provide such an underwire structure that has a greater cushioning ability or greater "loft" than the underwire structures of the prior art.

It is still another object of the present invention to provide such an underwire structure that avoids having a thick appearance and/or a stiff feel.

It is yet another object of the present invention to provide such an underwire structure that can be used in a number of different sized brassieres.

It is a further object of the present invention to provide such an underwire structure that is particularly comfortable to wear, and can be conveniently assembled in the brassiere.

It is still a further object of the present invention to provide such an underwire structure that has its own casing.

These and other objects and advantages of the present invention are achieved by the underwire structure of the present invention. In a first embodiment, there is provided an outer fabric layer. The outer fabric layer has gelatinous strips, thereby separating at least one surface of the outer fabric layer into sections. An inner fabric layer is positioned upon the gelatinous strips of the outer fabric layer. This inner fabric layer is preferably non-woven. An underwire is positioned on the inner fabric layer opposite the outer fabric layer. The outer fabric layer is then folded onto itself to enclose the gelatinous strips, the inner fabric layer and the underwire. Thus, the underwire is enclosed in a casing formed by the outer and inner fabric layers. Once the outer fabric layer is folded onto itself, a fold line is created.

In a second embodiment, there is provided three fabric layers and an underwire. As in the first embodiment, the outer fabric layer has at least one surface with gelatinous strips, thereby separating the surface and/or outer fabric layer into sections. The outer fabric layer forms an outside covering for the underwire. As in the first embodiment, an inner fabric layer is positioned on the underwire to form an inside covering for the underwire. The inner fabric layer is preferably non-woven. An intermediate fabric layer is positioned between the outer and inner fabric layers to form a second interior covering for the underwire. The underwire is positioned on the inner fabric layer opposite the intermediate fabric layer. The outer fabric layer is folded onto itself to enclose the inner and intermediate fabric layers and the underwire. Thus, the underwire is encased by all three fabric layers. In this second embodiment, a fold line is knitted into the outer fabric layer before the outer fabric layer is folded onto itself.

In a third embodiment, there is also provided an underwire. The underwire is surrounded by a non-woven fabric layer. A bladder containing a gelatinous material is encased by a rigid-type fabric. The bladder is positioned on the non-woven fabric layer opposite the underwire. The purpose of the non-woven fabric is to reduce the risk of the underwire poking through the rigid fabric encasing the bladder. The bladder is preformed or pre-made into a preshaped configuration. The fabric encasing the bladder is preferably a rigid fabric. More preferably, the fabric encasing the bladder is a tricot or warp knit fabric. The non-woven fabric is wrapped around the underwire, and the bladder is positioned against the body fabric that forms the breast cup of the brassiere.

In all embodiments, the non-woven fabric layer may also be made of a stretchable material.

BRIEF DESCRIPTION OF THE DRAWINGS

The objects and advantages of the present invention will be more apparent from the following detailed description of the present invention, in conjunction with the accompanying drawings wherein.

DETAILED DESCRIPTION OF THE INVENTION

Figure 1:
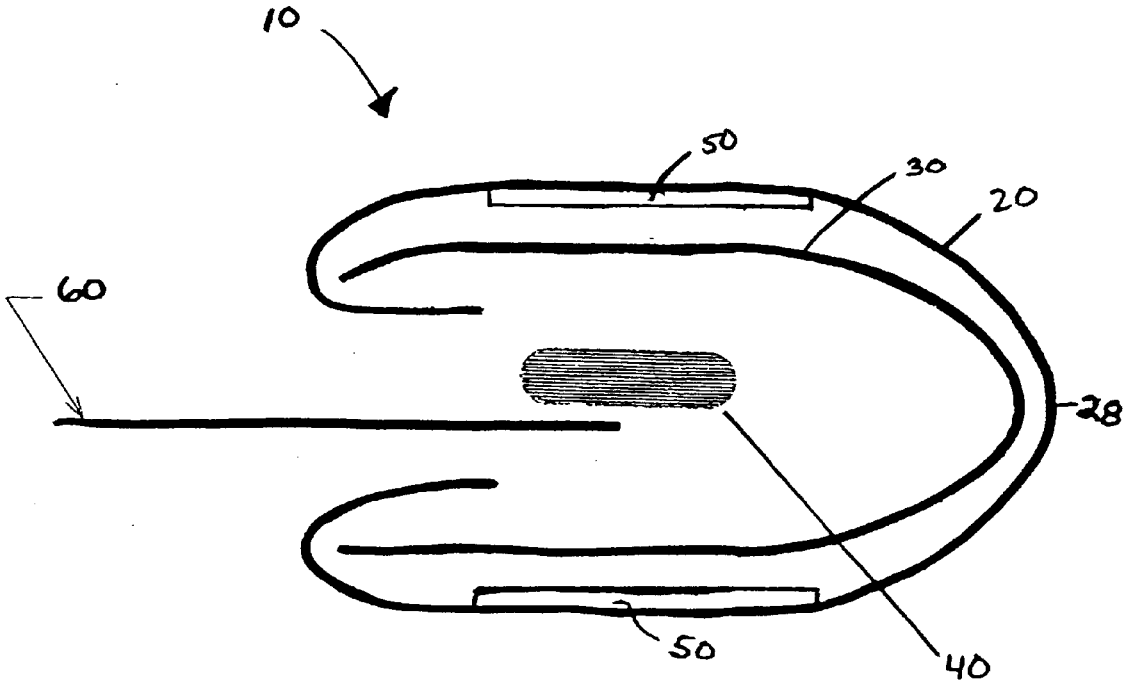
FIG. 1 is a schematic drawing showing a first embodiment of the present invention.

Referring to the drawings, and in particular, FIG. 1, there is provided a first embodiment of an underwire structure of the present invention generally represented by reference numeral 10. Underwire structure 10 has a first or outer layer of material 20 upon which a gelatinous material is applied in strips. Preferably, gelatinous material 50 is applied in one or more strips to outer material layer 20. A second or inner layer of material 30 is positioned adjacent to gelatinous material 50 on outer material layer 20, and an underwire 40 positioned on or adjacent to inner material layer 30 opposite outer material layer 20.

Figure 2:
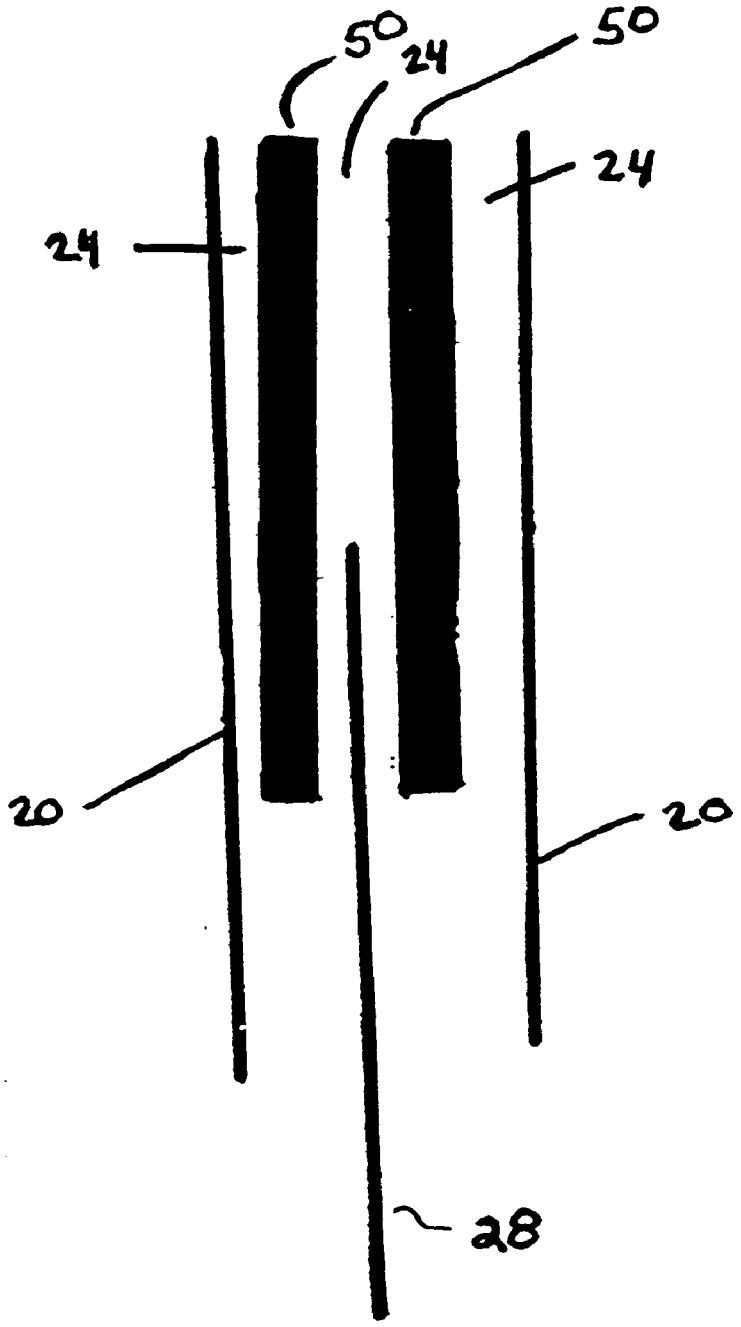
FIG. 2 is a magnified view of the stretch fabric used in the first embodiment of the present invention.

As shown in FIG. 2, outer material layer 20 preferably has two strips of gelatinous material 50 placed thereon. Accordingly, outer material layer 20 preferably has three regions that are not covered by gelatinous material 50. These three regions are two sew regions or edges 24, and a fold line or third sew region 28. Fold line 28 is located along the center of outer material layer 20.

Referring again to FIG. 1, outer material layer 20 with gelatinous material 50 is adjacent to inner material layer 30 with one side of inner material layer 30 contacting gelatinous material 50. Outer material layer 20, gelatinous material 50 and inner material layer 30 are wrapped around underwire 40. A body fabric 60 is positioned on a side of underwire 40 opposite inner material layer 30. Outer material layer 20 with gelatinous material 50 provide a cushiony feel and loft about underwire 40 thereby making the underwire structure more comfortable for the wearer. Inner material layer 30 provides that underwire 40 does not poke through outer material layer 20.

During assembly, inner material layer 30 is positioned adjacent to gelatinous material 50 of outer material layer 20. Underwire 40 is positioned on or adjacent to inner material layer 30 opposite outer material layer 20. Body fabric 60 is positioned on one side of underwire 40 opposite inner material layer 30. Preferably, a portion of body fabric 60 is positioned on one side of underwire 40 such that body fabric 60 is in the same plane as underwire 40. Outer material layer 20 is then folded onto itself about fold line 28 to enclose gelatinous material 50 and inner material layer 30 about the end of body fabric 60 and underwire 40. When outer material layer 20 and inner material layer 30 are folded along fold line 28, a channel is created for underwire 40. Thus, in this embodiment, a casing for underwire 40 is formed by outer material layer 20, gelatinous material 50 and inner material layer 30. In the first embodiment shown in FIG. 1, the underwire casing is sealed using single needle stitching.

Figure 3:
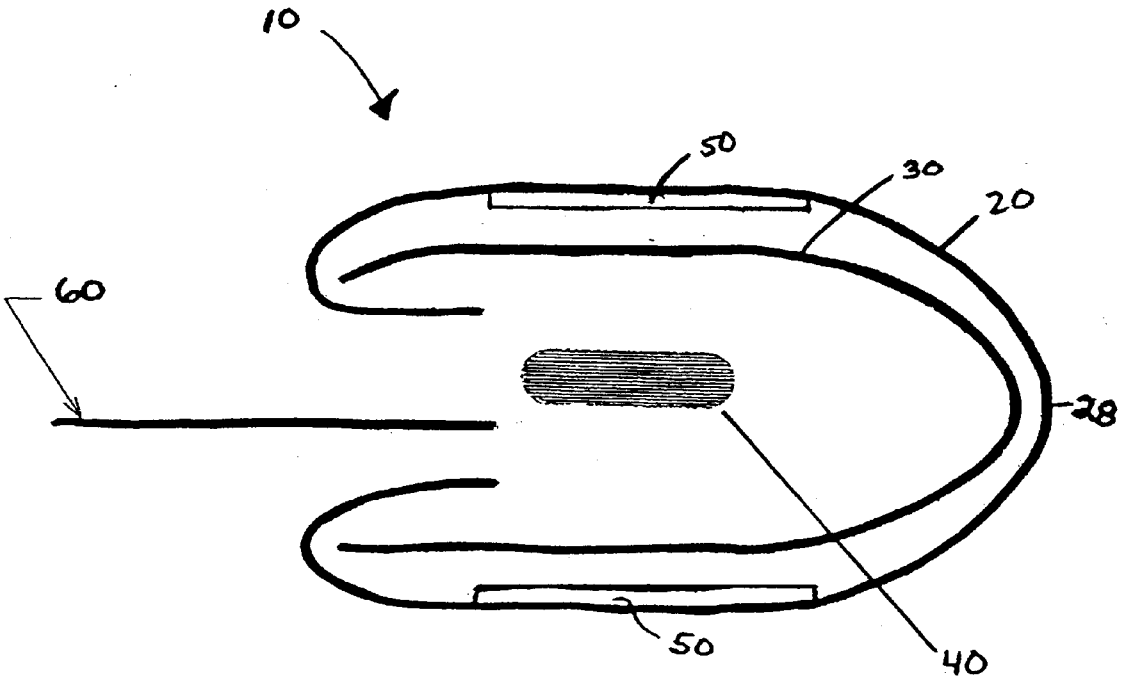
FIG. 3 is a schematic drawing showing an alternative to the first embodiment of the present invention.

Body fabric 60 may be positioned in alternative locations in relation to underwire structure 10. Referring to FIG. 3, body fabric 60 may be positioned such that it is not in the same plane as underwire 40. Instead, when outer material layer 20 is folded onto itself, body fabric 60 is sandwiched directly between the ends of outer fabric layer 20 and does not come into contact with underwire 40.

Figure 4:
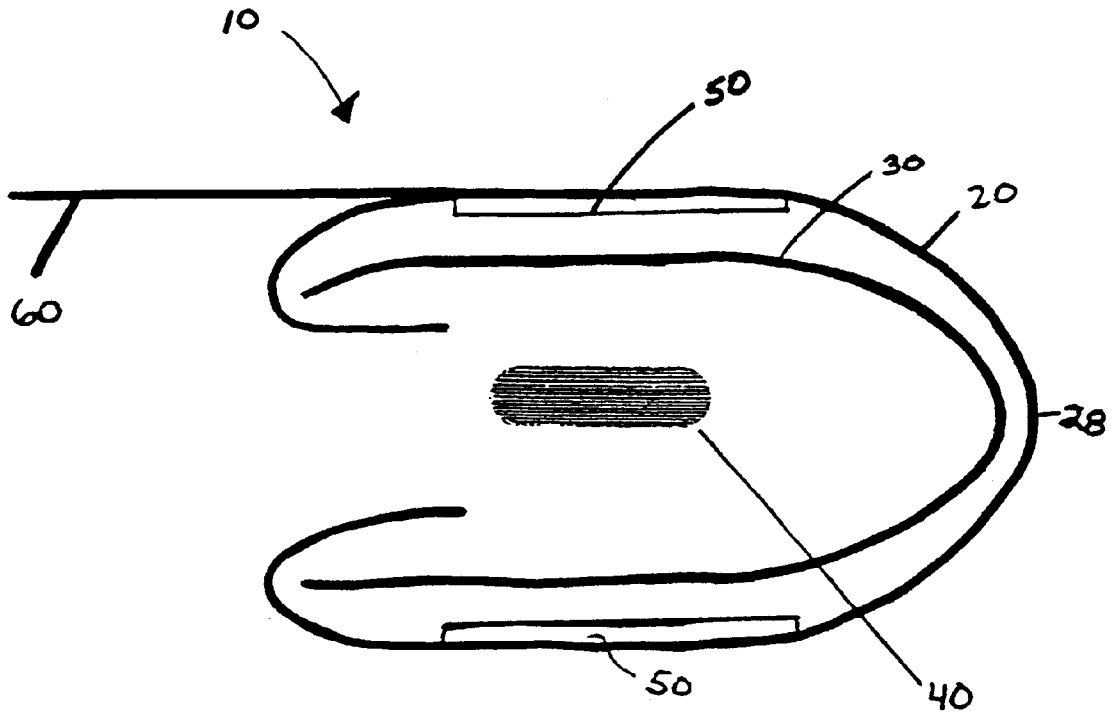
FIG. 4 is a schematic drawing showing a second alternative to the first embodiment of the present invention.

Referring to FIG. 4, body fabric 60 may be connected to outer material layer 20 at an upper edge of underwire structure 10. This type of underwire casing is sealed using double needle stitching.

Figure 5:
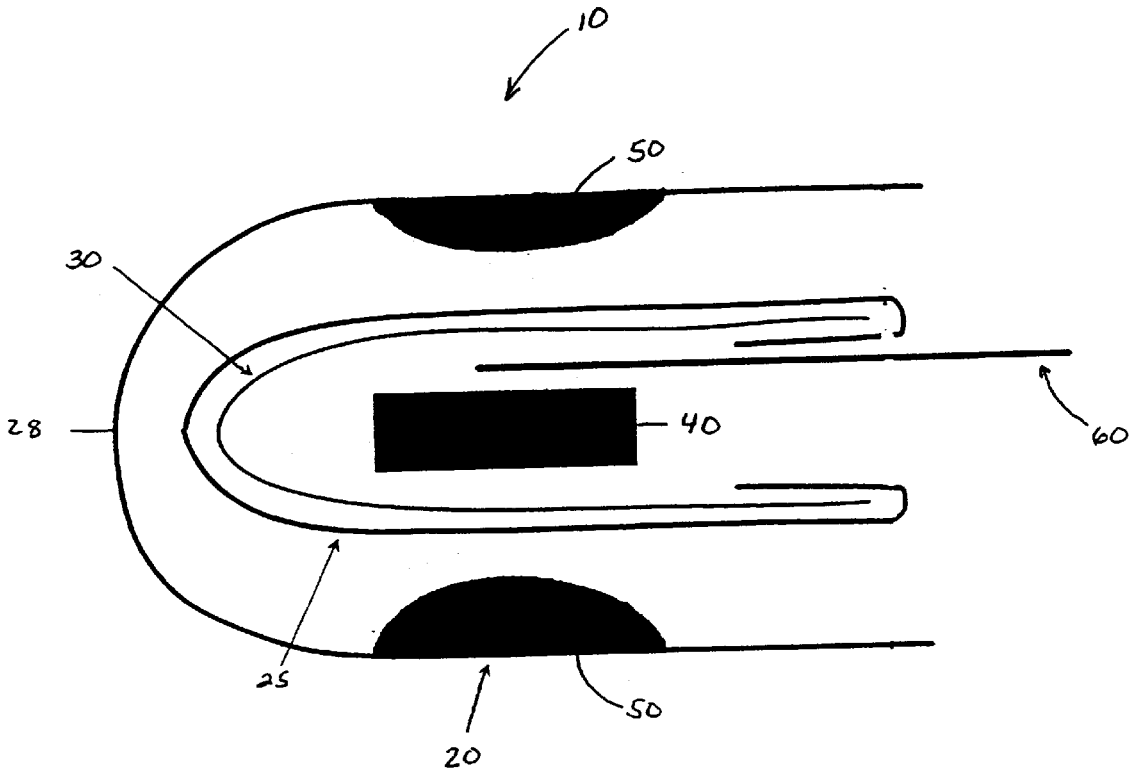
FIG. 5 is a schematic drawing showing a second embodiment of the present invention.

In a second embodiment of the present invention, shown in FIG. 5, underwire structure 10 has three layers of material, an outer material layer 20, an inner material layer 30 and an intermediate material layer 25 positioned between outer material layer 20 and inner material layer 30, and an underwire 40 positioned on inner material layer 30 opposite intermediate material layer 25. Gelatinous material 50 is placed on an interior surface of outer material layer 20. Outer material layer 20 forms an outside covering around gelatinous material 50 intermediate layer 25, inner material layer 30 and underwire 40.

Inner material layer 30 is positioned on underwire 40 to form an inside covering for the underwire. The function of inner material layer 30 is to prevent underwire 40 from poking through the other layers of material.

Intermediate material layer 25 is positioned between outer material layer 20 and inner material layer 30 to form a second interior covering for underwire 40. Body fabric 60 is preferably positioned on one side of underwire 40 opposite inner material layer 30. The positioning of body fabric 60 in FIG. 5 is analogous to the positioning shown in FIG. 1 in that a portion of the body fabric is in the same plane as underwire 40.

Outer material layer 20 is folded onto itself about fold line 28 to enclose inner material layer 30 and intermediate material layer 25 about the end of body fabric 60 and underwire 40 creating a multi-layer underwire channel for housing the underwire. Thus, in this embodiment, a casing for underwire 40 is formed by outer material layer 20, gelatinous material 50, intermediate material layer 25 and inner material layer 30. In this embodiment, stitching, preferably, single needle stitching, is used to seal the casing.

Figure 6:
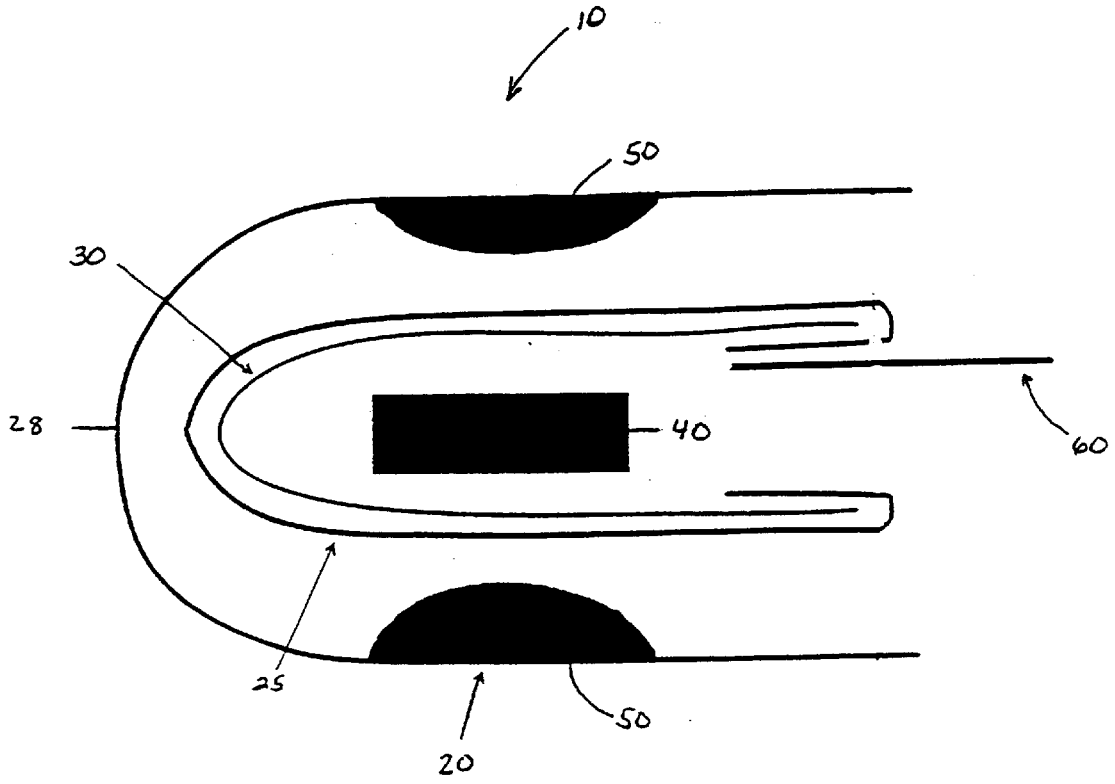
FIG. 6 is a schematic drawing showing an alternative to the second embodiment of the present invention.

As discussed with reference to FIGS. 3 and 4, body fabric 60 may be positioned in alternative locations in relation to underwire structure 10. As shown in FIG. 6, body fabric 60 is positioned such that it is not in the same plane as underwire 40. Instead, when outer material layer 20 is folded onto itself, body fabric 60 is sandwiched directly between the ends of intermediate fabric layer 25. In another alternative, body fabric 60 is connected to outer material layer 20 at an upper edge of underwire structure 10. As in FIG. 4, this type of casing is sealed utilizing stitching, preferably double needle stitching.

Outer material layer 20 is preferably made of a stretchable material. More preferably, outer material layer 20 is made of a three bar powernet knit. Outer material layer 20 may be made of varying combinations of nylon and spandex. The percentage of nylon ranges from about 78% to about 84% based on fabric content, while the percentage of spandex ranges from about 16% to about 22% based on fabric content. Preferably, outer material layer 20 is made of about 81% nylon and about 19% spandex. Outer material layer 20 is lightweight, ranging from about 5 ounces per yard squared ($oz/yd^2$) to about 5.8 $oz/yd^2$. The tensile length of outer material layer 20 is minimally about 25 pounds (lbs.), while the tensile width of outer material layer 20 is minimally about 33 lbs.

Gelatinous material 50 is preferably silicone. However, any liquid material can be used that is safe for contact with a wearer and has a soft feel. Gelatinous material 50 is applied on outer material layer 20 in strips or tracks. Preferably, gelatinous material 50 is about 56% of the overall weight of the combination of outer material layer 20 and gelatinous material 50. The height or thickness of the strips of gelatinous material 50 ranges from about 0.02 inches to about 0.03 inches. The width of these strips ranges from about 3/16 inches to about 1/4 inches. The width between the strips ranges from about 1/16 inches to about 1/8 inches. The width of sew region 24 ranges from about 1/8 inches to about 3/16 inches.

Inner material layer 30 is preferably made of a non-woven, non-stretchable fabric material. However, inner material layer 30 may be made of a stretchable material. Inner material layer 30 is preferably made of polyester. More preferably, inner material layer 30 is made of 100% polyester. Inner material layer 30 is lightweight, preferably about 5 oz./yd$^2$+/−10%. The burst strength of inner material layer 30 is minimally about 110 lb. per square inch. The tensile strength of inner material layer 30 is minimally about 55 lbs. The preferred thickness of inner material layer 30 falls in the range of about 0.53 mm to about 0.84 mm. Inner material layer 30 is sold commercially under the name TIETEX® by Tietex International Ltd.

Intermediate material layer 25 is a preferably a woven, non-stretchable material. However, intermediate material layer 25 may be made of a stretchable material. More preferably, intermediate material layer 25 is a nylon taffeta. Intermediate material layer 25 is also lightweight, ranging from about 1.8 oz/yd$^2$ to about 2.2 oz/yd$^2$. The tensile length of intermediate material layer 25 is minimally about 70 lbs., while the tensile width of intermediate material layer is minimally about 60 lbs.

It should be understood that these dimensions may vary depending upon the desired criteria for each group of potential customers.

In either embodiment, an important aspect of the present invention is that the casing of the underwire preferably be stretchable. However, it may be non-stretchable.

Figure 7:
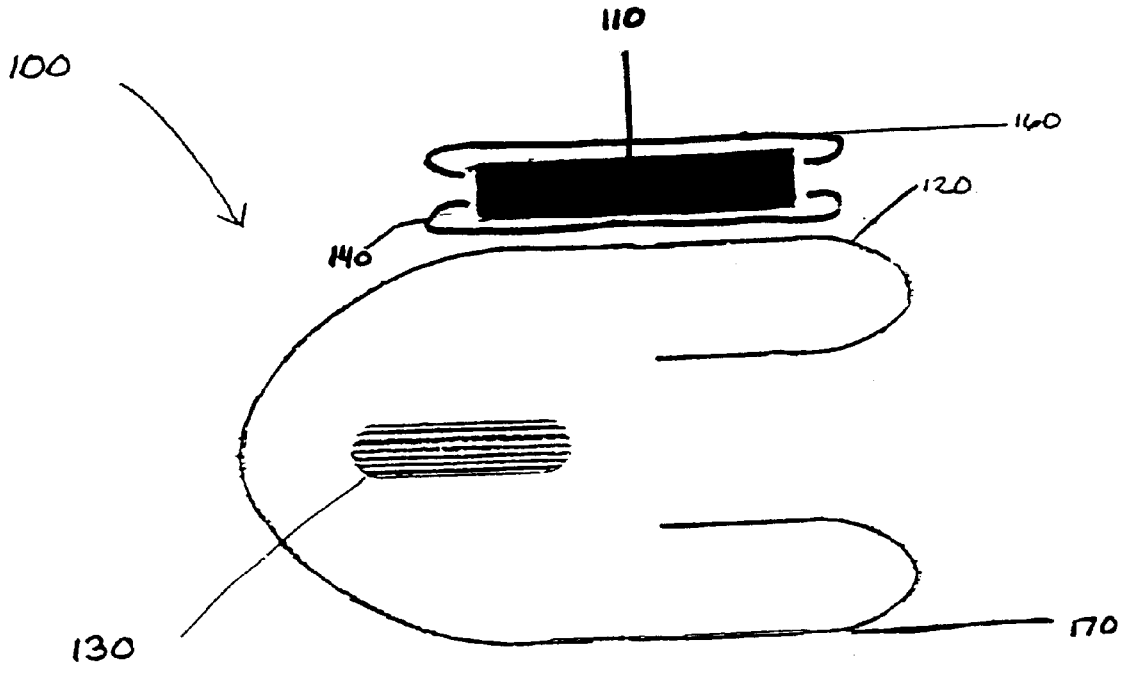
FIG. 7 is a schematic drawing showing a third embodiment of the present invention.

Referring to FIG. 7, there is provided a third embodiment of the underwire structure of the present invention generally represented by reference numeral 100. Underwire structure 100 includes a two ply structure that has a bladder 110 having a gelatinous material placed in or on a layer of a first fabric 140. The gelatinous material is preferably silicone, but may be any type of liquid material that is safe for contact with a wearer and has a soft feel. This structure is placed on a layer of a second fabric 120, and an underwire 130. In this embodiment, only second fabric layer 120 is wrapped around underwire 130. First fabric layer 140 with bladder 110 is positioned on the second fabric layer 120/underwire 130 structure with bladder 110 positioned against a body fabric 160 and opposite a garment or outer brassiere layer 170. In this embodiment, double needle stitching is preferably used to seal the casing. First fabric layer 140 is a rigid fabric, such as a tricot or warp knit fabric, which does not stretch.

Significantly, the bladder configuration can fit a number of different underwire sizes. Preferably, one bladder will fit at least three sizes of underwires.

In all embodiments of the present invention, each end of the underwire optionally may have a protective tip positioned thereon. In addition, the wire casing or channel must have enough room at its ends to avoid poke-through of the underwire.

The present invention provides underwire structures that have the underwire encased by a gelatinous material. These structures provide a cushiony feel, yet are not thick or bulky. Moreover, the cushiony feel is so pronounced that there is a loft created so that the wearer has a softness and pliability, yet the desired support under the breast area.

The present invention having been described with particular reference to the preferred forms thereof, it will be obvious that various changes and modifications may be made without departing from the spirit and scope of the invention as defined herein.

What is claimed is:

1. A cushioning structure for an underwire of a brassiere, comprising:

a first layer of fabric disposed about at least a portion of said underwire;

a gelatinous material between said first layer and said underwire; and a second layer of fabric between said gelatinous material and said underwire, wherein said second layer is made of a non-woven, non-stretchable material.

2. The cushioning structure of claim 1, further comprising a third layer of fabric between said gelatinous material and said second layer.

3. The cushioning structure of claim 2, wherein said third layer is a woven, non-stretchable material.

4. A cushioning structure for an underwire of a brassiere, comprising:

a first layer of fabric disposed about at least a portion of said underwire; and a gelatinous material between said first layer and said underwire.

5. The cushioning structure of claim 4, further comprising a second layer of fabric between said gelatinous material and said underwire.

6. The cushioning structure of claim 4, wherein said first layer is folded upon itself to enclose said gelatinous material and said underwire.

7. The cushioning structure of claim 4, wherein said gelatinous material is silicone.

8. The cushioning structure of claim 4, wherein said underwire has a first end and a second end, and wherein each of said first and second ends has a protective tip positioned thereupon.

9. The cushioning structure of claim 4, wherein said first layer is made of a stretchable material.

10. The cushioning structure of claim 4, herein said first layer is made of a three bar powerknit knit.

11. The cushioning structure of claim 4, wherein said first layer is made of a combination of nylon and spandex.

12. The cushioning structure of claim 4, wherein said first layer is about 78% to about 84% nylon.

13. The cushioning structure of claim 4, wherein said first layer is about 16% to about 22% spandex.

14. The cushioning structure of claim 4, wherein said first layer is about 81% nylon and 19% spandex.

15. The cushioning structure of claim 5, wherein said second layer is made of polyester.

16. The cushioning structure of claim 5, wherein said second layer is made of 100% polyester.

17. The cushioning structure of claim 6, wherein said third layer is made of nylon taffeta.

18. A cushioning structure for an underwire of a brassiere, comprising a composite structure having at least one layer of fabric and at least one layer of a gelatinous material, said composite structure having an overall weight, wherein said at least one layer of gelatinous material has a weight of about 56% of said overall weight.

19. A cushioning structure for an underwire of a brassiere comprising:

a first layer of fabric having a gelatinous material applied to an interior side of said first layer, said first layer having two lateral edges;

a second layer of fabric being positioned on said gelatinous material; and an underwire being positioned on said second layer opposite said first layer, wherein said underwire is enclosed by said first layer, said gelatinous material, and said second layer.

20. The cushioning structure of claim 19, further comprising a third layer of fabric positioned between said gelatinous material and said second layer.

21. The cushioning structure of claim 20, wherein said third layer of material has a weight ranging from about 1.8 oz/yd$^2$ to about 2.2 oz/yd$^2$.

22. The cushioning structure of claim 19, wherein said gelatinous material is applied in one or more strips to said interior side of said first layer.

23. The cushioning structure of claim 22, wherein each of said one or more strips of said gelatinous material have a thickness ranging from about 0.020 inches to about 0.030 inches and a width ranging from about 3/16 inches to about 1/4 inches.

24. The cushioning structure of claim 22, wherein each of said one or more strips of said gelatinous material have a width between said strips ranging from about 1/16 inches to about 1/8 inches.

25. The cushioning structure of claim 19, wherein said first layer has a plurality of sew regions.

26. The cushioning structure of claim 19, wherein each of said two lateral edges has a sew region.

27. The cushioning structure of claim 19, wherein said first layer has a fold line located centrally between said two lateral edges.

28. The cushioning structure of claim 19, wherein said first layer is folded upon itself about said fold line to enclose said gelatinous material, and wherein said second layer and said underwire and said lateral edges are connectively joined to form a casing.

29. A cushioning structure for an underwire of a brassiere comprising:

a bladder having a gelatinous material within;

a first layer of material being disposed about said bladder;

an underwire being enclosed in a second layer of material, wherein said first layer with said bladder is positioned on said second layer opposite a body fabric, and wherein said body fabric is positioned opposite an outer brassiere layer.

30. The cushioning structure of claim 29, wherein said first layer is a rigid fabric.

31. The cushioning structure of claim 29, wherein said first layer is a tricot or a warp knit fabric.

32. The cushioning structure of claim 29, wherein said bladder can accommodate a plurality of underwire sizes.

33. A method of forming a cushioned underwire structure comprising the steps of:

applying a gelatinous material to a side of a first layer of material;

positioning a second layer of material on said gelatinous material opposite said first layer;

positioning an underwire upon said second layer opposite said gelatinous material;

folding said first layer upon itself about a fold line to enclose said gelatinous material, said second layer of material and said underwire thereby forming a casing; and sealing said casing along an upper edge of said first layer of material opposite said fold line.

34. The method of claim 33, further comprising positioning a third layer of material between said gelatinous material and said second layer of material.

* * * * *